US008905281B2

(12) United States Patent
Jesewitz

(10) Patent No.: US 8,905,281 B2
(45) **Date of Patent: *Dec. 9, 2014**

(54) CARGO RACK ASSEMBLY FOR WAKEBOARD BOATS POSITIONED ABOVE BOAT TOWER

(71) Applicant: Raymond L. Jesewitz, Longwood, FL (US)

(72) Inventor: Raymond L. Jesewitz, Longwood, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/066,629

(22) Filed: Oct. 29, 2013

(65) Prior Publication Data

US 2014/0054341 A1 Feb. 27, 2014

Related U.S. Application Data

(63) Continuation-in-part of application No. 13/967,137, filed on Aug. 14, 2013, which is a continuation-in-part of application No. 13/214,149, filed on Aug. 19, 2011, now Pat. No. 8,567,651, which is a continuation-in-part of application No. 11/711,282, filed on Feb. 27, 2007, now Pat. No. 8,025,194, said application No. 13/214,149 is a continuation-in-part of application No. 13/160,542, filed on Jun. 15, 2011, now abandoned.

(60) Provisional application No. 60/777,060, filed on Feb. 27, 2006.

(51) Int. Cl.
*B63B 17/00* (2006.01)
*B63B 25/00* (2006.01)

(52) U.S. Cl.
CPC ..... *B63B 25/00* (2013.01); *B63B 17/00* (2013.01)
USPC ..... 224/406; 224/282; 224/548; 114/343

(58) Field of Classification Search
USPC ..... 224/406, 274, 405, 311, 280, 401, 282, 224/548, 549, 553; 114/343, 364
See application file for complete search history.

(56) References Cited

U.S. PATENT DOCUMENTS

| | | | | |
|---|---|---|---|---|
| 3,049,273 | A * | 8/1962 | Crane | 224/311 |
| 4,424,907 | A * | 1/1984 | Robb | 211/70.8 |
| 5,094,351 | A * | 3/1992 | Barney | 211/70.8 |
| D434,718 | S * | 12/2000 | Kreisler | D12/412 |
| 6,257,261 | B1 * | 7/2001 | Johnson | 135/96 |
| 6,327,993 | B1 * | 12/2001 | Richens, Jr. | 114/361 |
| 6,349,666 | B1 * | 2/2002 | Hastings | 114/361 |
| 6,439,150 | B1 * | 8/2002 | Murphy et al. | 114/361 |
| 6,572,168 | B1 * | 6/2003 | Radstake | 312/247 |
| 6,691,637 | B1 * | 2/2004 | Smith et al. | 114/361 |

(Continued)

OTHER PUBLICATIONS

Wake World article Oct. 2005—showing and describing Z5 Cargo Rack on Malibu Illusion tower: http://wakeworld.com/news/latestinwake/2005-wakeboard-expo-01-08-10-15-05-44-412.html see paragraph and photo starting with "Speaking of Malibu, they busted out one of their new Wakesetter 247 models . . . ".

(Continued)

*Primary Examiner* — Justin Larson
(74) *Attorney, Agent, or Firm* — Paul Royal; The Patent Guild

(57) ABSTRACT

The present invention provides an improved cargo rack apparatus for wakeboard boats positioned above the boat tower.

14 Claims, 19 Drawing Sheets

(56) References Cited

U.S. PATENT DOCUMENTS

| | | | | |
|---|---|---|---|---|
| 6,799,529 | B1 * | 10/2004 | Willis | 114/361 |
| 6,866,001 | B1 * | 3/2005 | Cuccia | 114/343 |
| 7,418,918 | B2 * | 9/2008 | Bierbower et al. | 114/361 |
| D597,922 | S * | 8/2009 | Davis | D12/317 |
| D606,481 | S * | 12/2009 | Stepp | D12/317 |
| 8,025,194 | B2 * | 9/2011 | Jesewitz | 224/406 |
| D649,505 | S * | 11/2011 | O'Dell | D12/317 |
| 8,297,484 | B2 * | 10/2012 | Jesewitz et al. | 224/406 |
| 8,495,967 | B2 * | 7/2013 | Williams et al. | 114/361 |
| 8,522,709 | B2 * | 9/2013 | Williams et al. | 114/361 |
| 8,567,651 | B2 * | 10/2013 | Jesewitz | 224/406 |
| 2005/0186029 | A1 * | 8/2005 | Jones | 403/385 |

OTHER PUBLICATIONS

WakeWorld thread Mar. 2006—showing underside of Malibu Z5 on Illusion tower: http://www.wakeworld.com/MB/Discus/messages/65921/306251.html?1142355403 see comments and photo of by Johnny Neves (johnny_jr) on Monday, Mar. 13, 2006.

* cited by examiner

CARGO RACK ASSEMBLY FOR WAKEBOARD BOATS POSITIONED ABOVE BOAT TOWER

CROSS REFERENCE TO RELATED APPLICATIONS

This application is a Continuation-In-Part of U.S. patent application Ser. No. 13/967,137, filed Aug. 14, 2013 which claims the benefit of U.S. patent application Ser. No. 13/214,149, filed Aug. 19, 2011, and issued as U.S. Pat. No. 8,567,651 which claims the benefit of U.S. patent application Ser. No. 11/711,282, filed Feb. 27, 2007, and issued as U.S. Pat. No. 8,025,194 which claims the benefit of U.S. Provisional Patent Application No. 60/777,060, filed Feb. 27, 2006 wherein all applications are incorporated by reference in their entirety as if fully set forth herein. Further, this application claims the benefit of U.S. Provisional Patent Application No. 61/363,259 filed Jul. 11, 2010, which claims the benefit of U.S. Provisional Patent Application Ser. No. 61/323,005, filed Apr. 12, 2010, wherein both provisional applications are incorporated by reference in their entirety as if fully set forth herein. Additionally this application claims the benefit of U.S. patent application Ser. No. 13/180,542, filed Jul. 11, 2011, and issued as U.S. Pat. No. 8,297,484.

FIELD OF THE INVENTION

The present invention relates generally to boating equipment and accessories, and more particularly to an improved cargo rack assembly for wakeboard boats which includes a cargo rack apparatus and a mounting apparatus.

BACKGROUND OF THE INVENTION

It is a truism among boating enthusiasts that there is never enough storage room on a boat. This is particularly true in wakeboarding and related water sports, where the boater may need a place to store wakeboards, surfboards, wakesurf boards, tubes, inflatables, kayaks, accessories, and/or other sport cargo.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

Disclosure of Invention

The present invention provides an improved cargo rack assembly for wakeboard boats and the like.

It is therefore an object of the present invention to provide a new and improved cargo rack assembly for wakeboard boats and the like.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application.

The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION

While the preferred cargo rack assembly is presented herein, it is understood alternate embodiments may encompass cargo racks differently configured or bimini tops (such as collapsible or welded frame bimini tops) as generally used within the industry. While these alternate cargo rack assembly embodiments may present elements of the instant invention, it is understood that they are not necessarily the equivalent to the cargo rack assembly of the preferred and alternate embodiments of the instant invention.

The cargo rack assembly of the instant invention includes a cargo rack apparatus and a mounting apparatus.

Cargo Rack Apparatus

As shown at least in the preferred and alternate embodiments as shown in FIGS. 1-9, the cargo rack assembly 100 of the instant invention includes a cargo rack apparatus 110 supported on a boat tower 114 by a mounting apparatus 200. The cargo rack apparatus 110 is pivotally attached to the tower 114 at at least one pivot joint and at least one pivoting releasable joint and as further describe herein.

Figure 1:
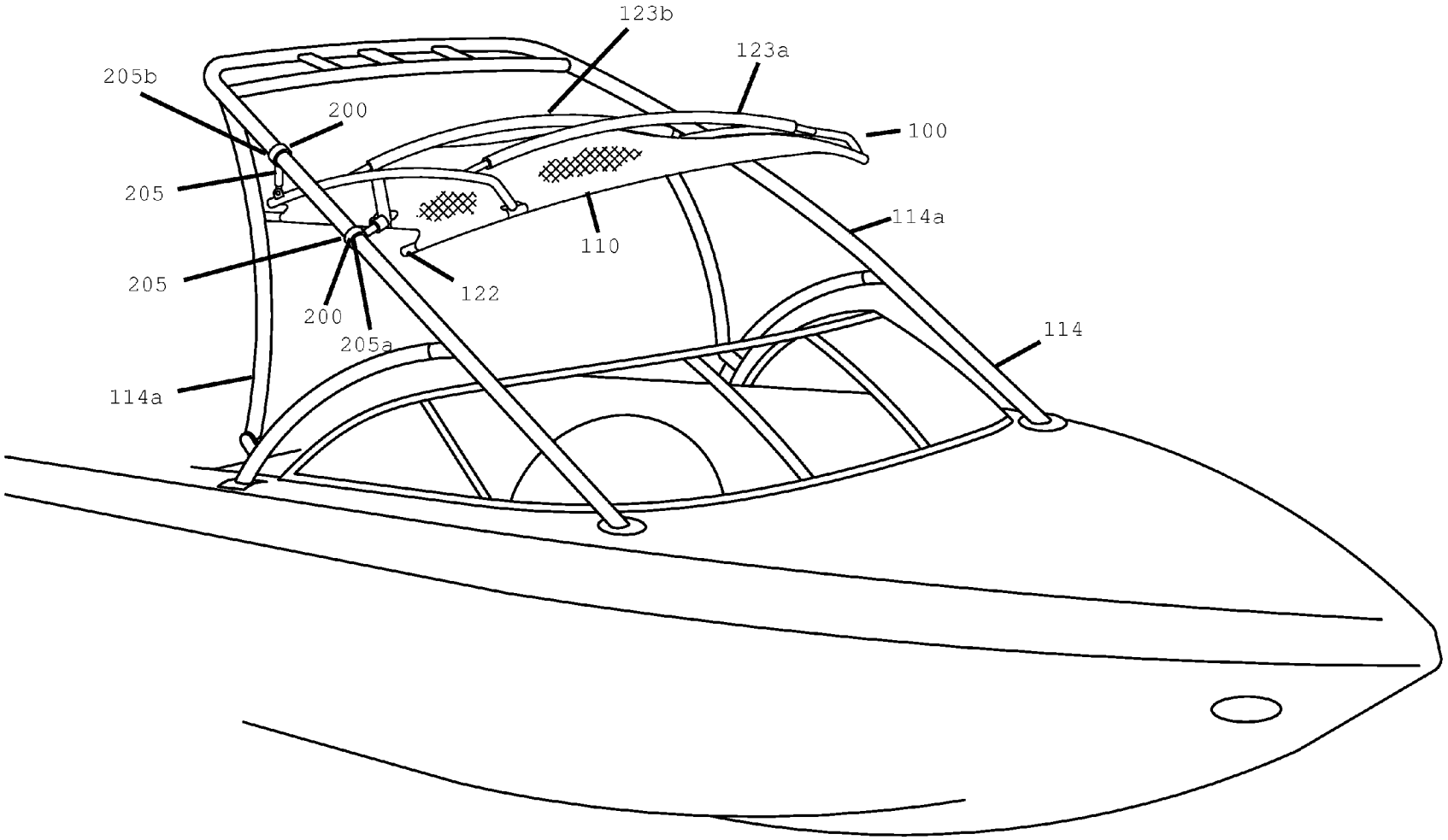
FIG. 1 is a view of the cargo rack assembly on a boat.
Figure 1A:
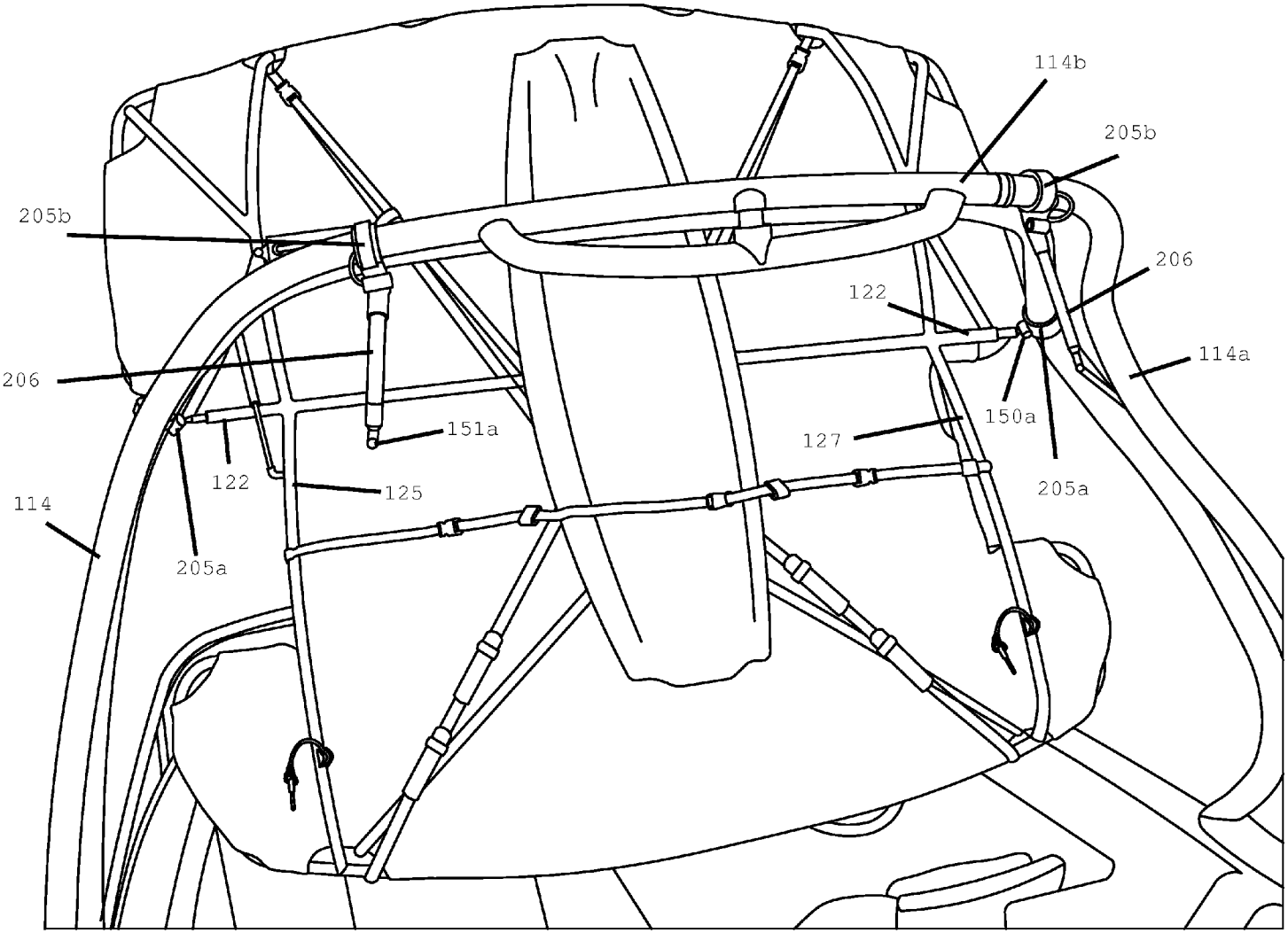
FIG. 1A shows a boat having a tower with a substantially horizontal portion.

As shown in FIG. 1 and FIG. 1A of the preferred embodiment, a set of four mounting apparatus rack links 205 connect the cargo rack apparatus 110 to the boat tower 114 (note the port side rack links 205 are not shown however they are attached in the same manner are relative position as shown for the starboard side mounting apparatus rack links 205).

Specifically, the boat tower 114 includes at least one substantially vertical port support and at least one substantially vertical starboard support both of which are considered as boat tower support 114*a*. The boat tower 114 may also include at least one portion 114*b* which is substantially horizontal and which interconnects the substantially vertical port support to the substantially vertical starboard support (see FIG. 1A).

The boat tower further includes a substantially horizontal second portion 114*c* interconnecting the port substantially vertical tower support and the starboard substantially vertical tower support.

The cargo rack apparatus 110 includes a cargo rack apparatus interior volume 132, and one or more connected peripheral rails 122 optionally including a cargo rack fore interconnecting rail 123*a*, a cargo rack aft interconnecting rail 123*b*, a cargo rack apparatus front rail 124, a cargo rack apparatus port side rail 125, a cargo rack apparatus back rail 126, a cargo rack apparatus starboard side rail 127, and interconnecting rails 122*a* wherein these peripheral rails 122 cooperate to provide a support surface for stored items. The cargo rack apparatus 110 selected to be attached to a particular boat may include any combination of the disclosed peripheral rails 122 and additional rails as applicable.

The cargo rack member 110 further comprises at least one substantially vertical rail 130 interconnecting at least some of said cargo rack rail portions 122, 128 and wherein the at least one substantially vertical cargo rack rail 130 (also 129) extends a vertical distance sufficient to form a vertical gap between at least some of said cargo rack rail portions 122, 128.

A portion of the substantially horizontal second portion 114*c* of the boat tower is positioned approximate the vertical gap between the cargo rack rail portions and, wherein a ski tow 140 is provided on the substantially horizontal second portion 114*c* of the boat tower at a location within the vertical gap between the cargo rack rail portions 122, 128. The vertical gap provides easy access to the ski tow 140.

Generally the mounting apparatus 200 includes at least one rack link 205 and optionally includes at least one rack shackle clamp 350. Further the mounting apparatus 200 optionally includes a cargo rack mounting adapter 400. Note, rack link 205 is alternatively presented herein as rack link 205*a* or rack link 205*b* as applicable.

Specifically, as shown in the preferred embodiment, a pivoting rack link 205*a* and a releasable rack link 205*b* is provided along the cargo rack apparatus port side rail 125 and a pivoting rack link 205*a* and a releasable rack link 205*b* is provided along the cargo rack apparatus starboard side rail 127. The pivoting rack link 205*a* is positioned foreword of the releasable rack link 205*b* with respect to the forward and aft axis of the boat.

Mounting Apparatus

Pivoting Rack Link

Figure 2:
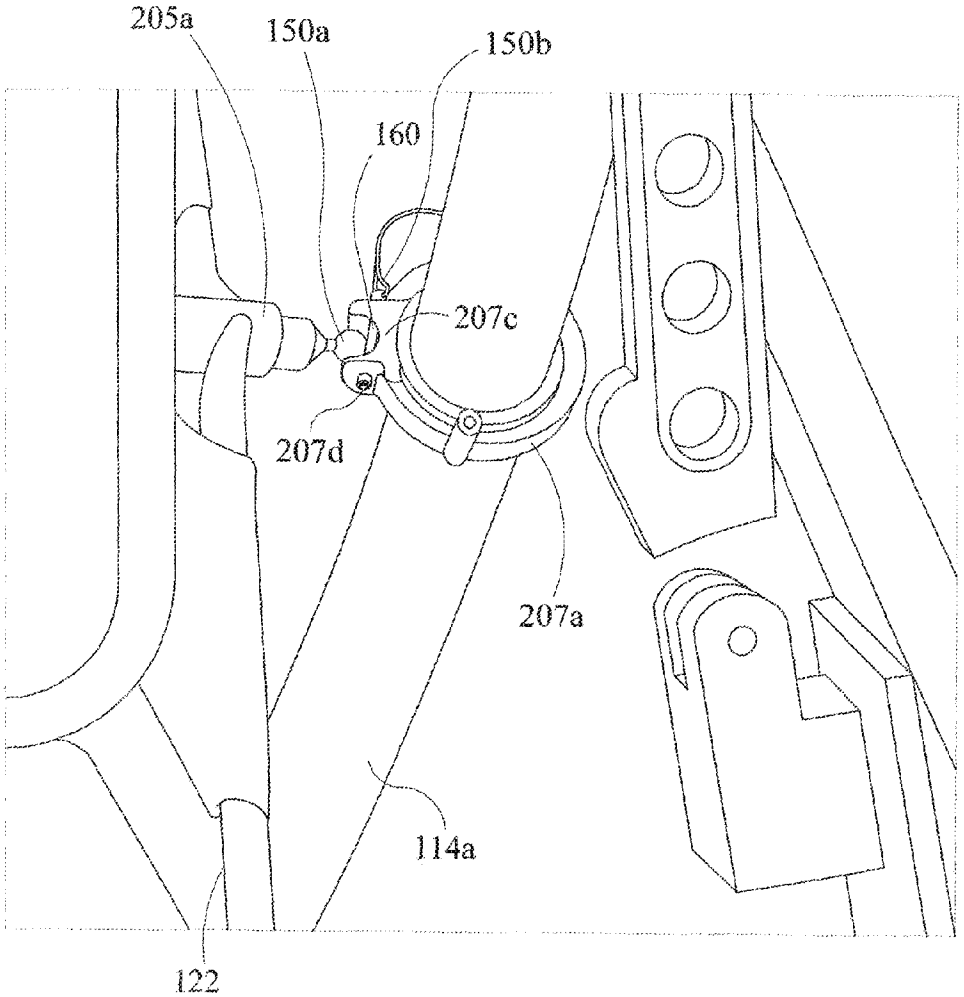
FIG. 2 shows a rack link mounted to a boat tower and cargo rack.
Figure 2A:
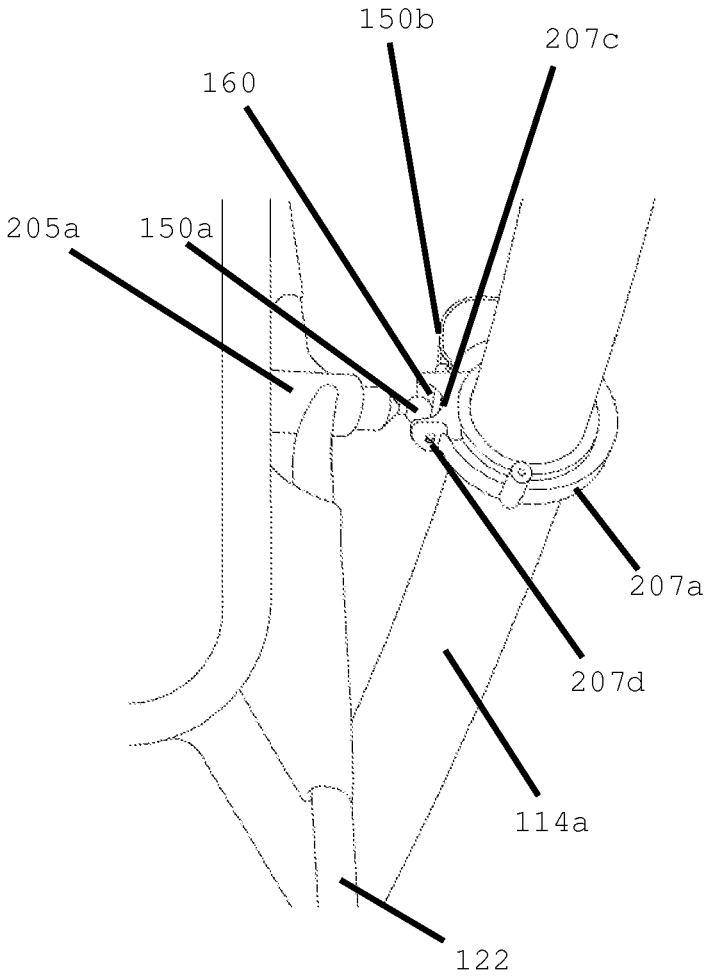
FIG. 2A shows a rack link mounted to a boat tower and cargo rack.

As shown at least in FIGS. 2 thru 2A, each pivoting rack link 205*a* includes a pivoting rack link connector ball 150*a*, a pivoting rack link removable pin 150*b*, a pivoting rack link socket 150*c*, a pivoting rack pin hole 150*d*, and a pivoting rack link clasp member 207*a*.

Each pivoting rack link connector ball 150*a* extends outward from a selected position on the applicable side rails 122, 125, 127.

Each pivoting rack link clasp member 207*a*, which connects the respective pivoting rack link 205*a* to the boat tower 114, is configured to complimentarily surround at least a portion of a boat tower support 114*a*.

A pivoting rack link clasp socket 207*c*, a pivoting rack link clasp pin hole 207*d*, and a pivoting rack link clasp removable pin 207*e* is provided on each pivoting rack link clasp member 207*a*.

The pivoting rack link clasp socket 207*c* includes a liner 160 to dampen the contact between the socket and the corresponding connector ball.

To connect the cargo rack apparatus 110 to the boat tower 114, as shown in FIG. 1, the rack link connector ball 150*a* (which extends outward from the applicable side rails 122, 125, 127) is positioned within the pivoting rack link clasp socket 207*c* and the pivoting rack link removable pin 150*b* is inserted into the pivoting rack link pin hole 150*d* to prevent dislodging or removal of the pivoting rack link connector ball 150*a* from the pivoting rack link clasp socket 207*c*.

The connector ball and socket combination provides the connection joint with rotational freedom while the removable pin provides the connection joint with releasability.

Releasable Rack Link

Figure 3:
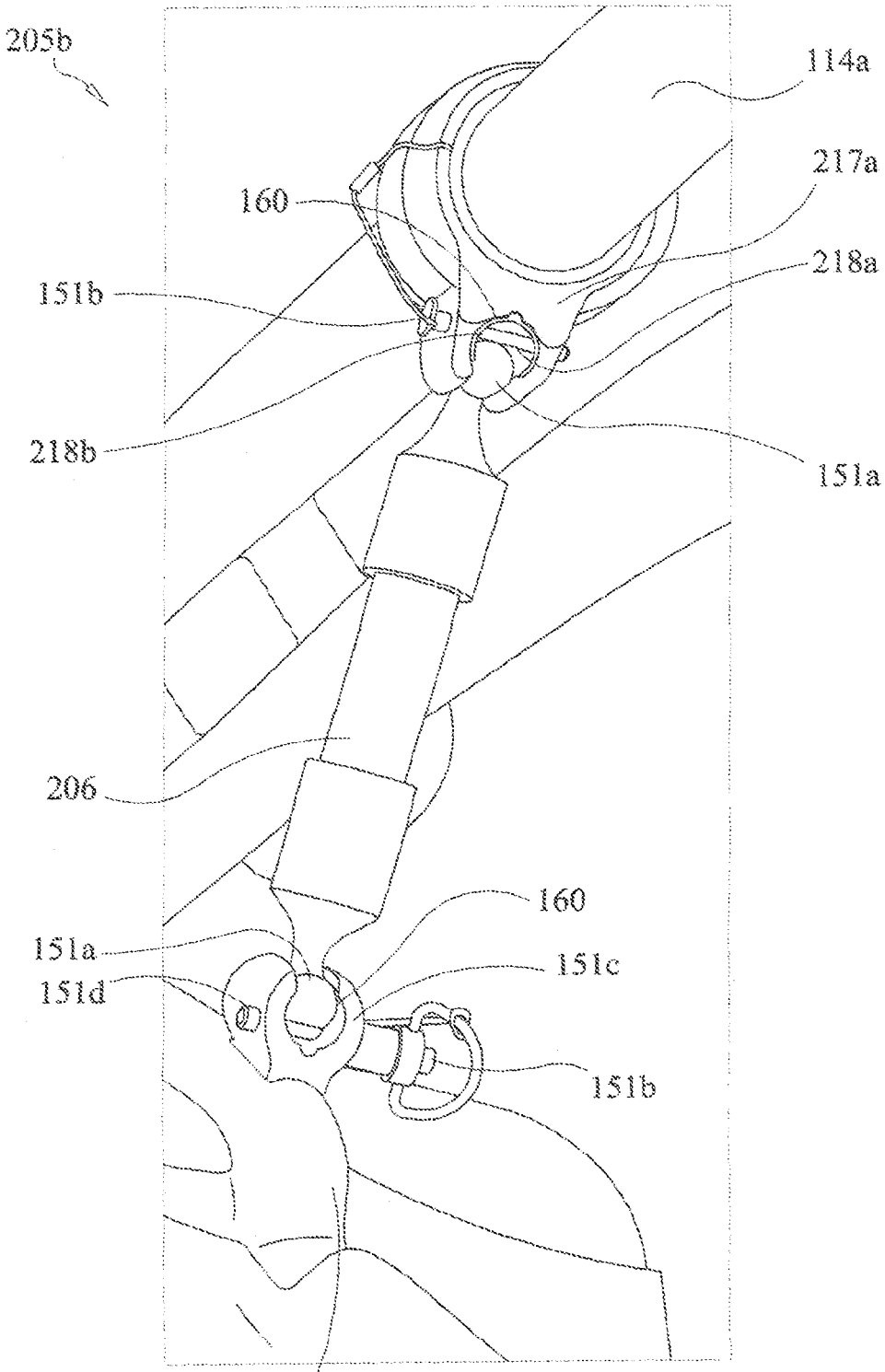
FIG. 3 shows a rack link mounted to a boat tower and cargo rack.
Figure 4:
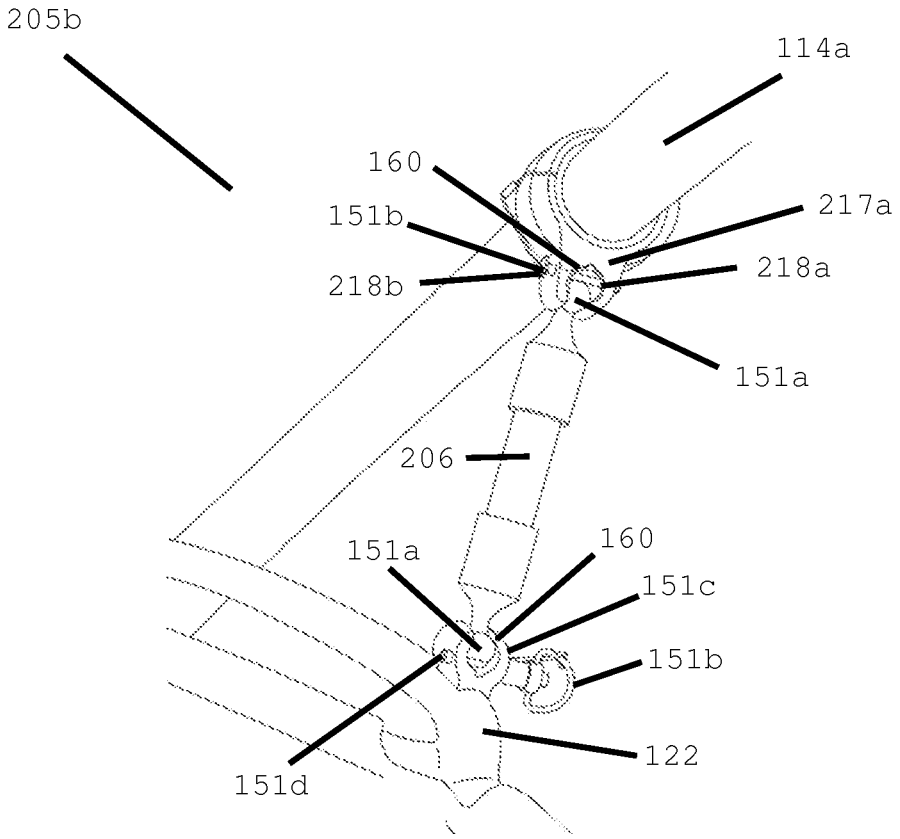
FIG. 4 shows a rack link mounted to a boat tower and cargo rack.
Figure 5A:
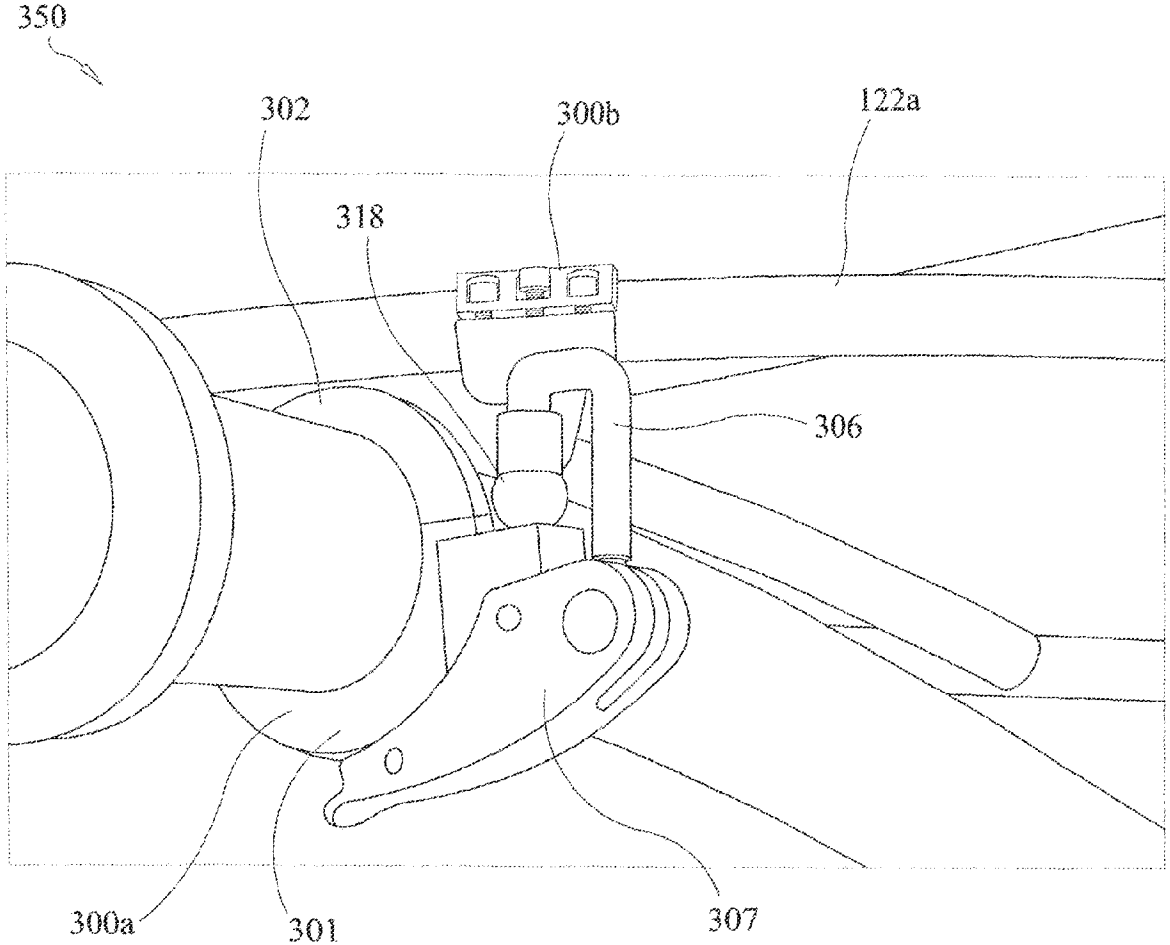
FIG. 5A shows a rack shackle clamp mounted to a boat tower and cargo rack.
Figure 5B:
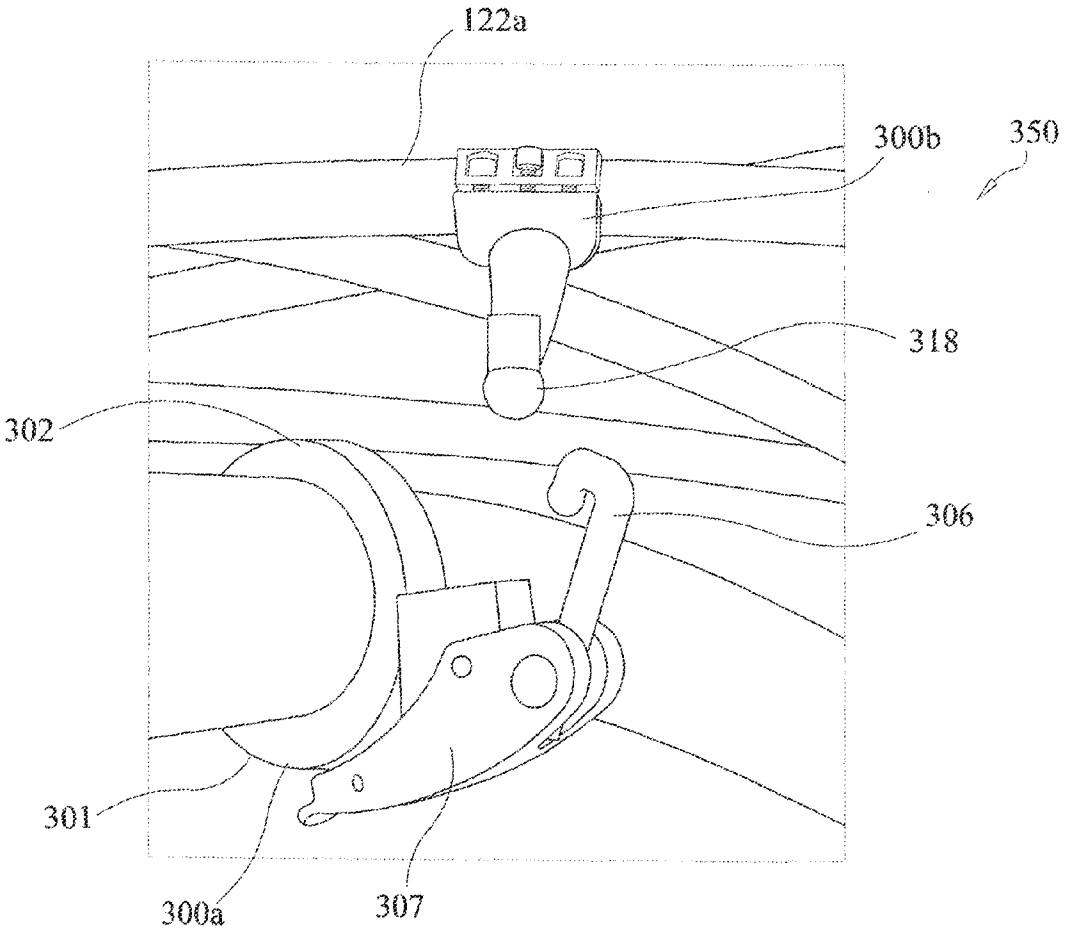
FIG. 5B shows a rack shackle clamp mounted to a boat tower and cargo rack.

As shown at least in FIGS. 3-4, each releasable rack link 205*b* includes a releasable rack link shaft 206 having a releasable rack link connector ball 151*a* provided on both ends of the shaft 206. Each releasable rack link 205*b* further includes releasable rack link removable pins 151*b*; a releasable rack link socket 151*c*; a releasable link rack pin hole 151*d*; a releasable rack link clasp member 217*a*; a releasable rack link clasp socket 218*a*; and a releasable rack link clasp pin hole 218*b*. The releasable rack link socket 151*c* and releasable rack link clasp socket 218*a* both include a liner 160 to dampen the contact between the sockets and the corresponding connector ball.

To connect the cargo rack apparatus 110 to the boat tower 114 via the releasable rack link 205*b*, as shown in FIG. 1, a releasable rack link socket 151*c* (including the releasable rack pin hole 151*d*) is positioned at an appropriate aft location on the cargo rack apparatus port side rail 125 and a releasable rack link socket 151*c* (including the releasable rack pin hole 151*d*) is positioned at an appropriate aft location on the cargo rack apparatus starboard side rail 127. Further a releasable rack link clasp member 217*a* is configured to complimentarily surround at least a portion of the boat tower support 114*a* adjacent to each releasable rack link socket 151*c* location. The respective releasable rack link shaft 206 is provided to interconnect the respective releasable rack link clasp member 217*a* to the respective releasable rack link socket 151*c* and the releasable rack link removable pins 151*b* are then inserted to prevent removal of the releasable rack link shaft 206.

Rack Shackle Clamp

The rack shackle clamp 350 provides an alternate method for interconnecting the cargo rack apparatus 110 to the boat tower 114 as shown in FIGS. 5A-7. The rack shackle clamp 350 is particularly useful when mounting the cargo rack apparatus 110 to the upper end or top of the boat tower 114.

Rack shackle clamp 350 generally includes, at least a lower clamp 300*a* which includes a lower clamp bottom 301, and a lower clamp top 302; an upper clamp 300*b*, which includes an upper clamp bottom 303, and an upper clamp top 313; a balled headed hook 306; a pivotally operated release handle 307; a lower insert 308*a*; an upper insert 308*b*; securing bolts 309; clamp stops 309*a*, 309*b*; retaining rings 310; an insert pin 311; a securing pin 312; a securing nut 314; a spring 315; supplemental bolts 316; a rack shackle clamp socket 318; and a rack shackle clamp neck 317 interconnecting the upper clamp bottom 303 to the rack shackle clamp socket 318.

Figure 7:
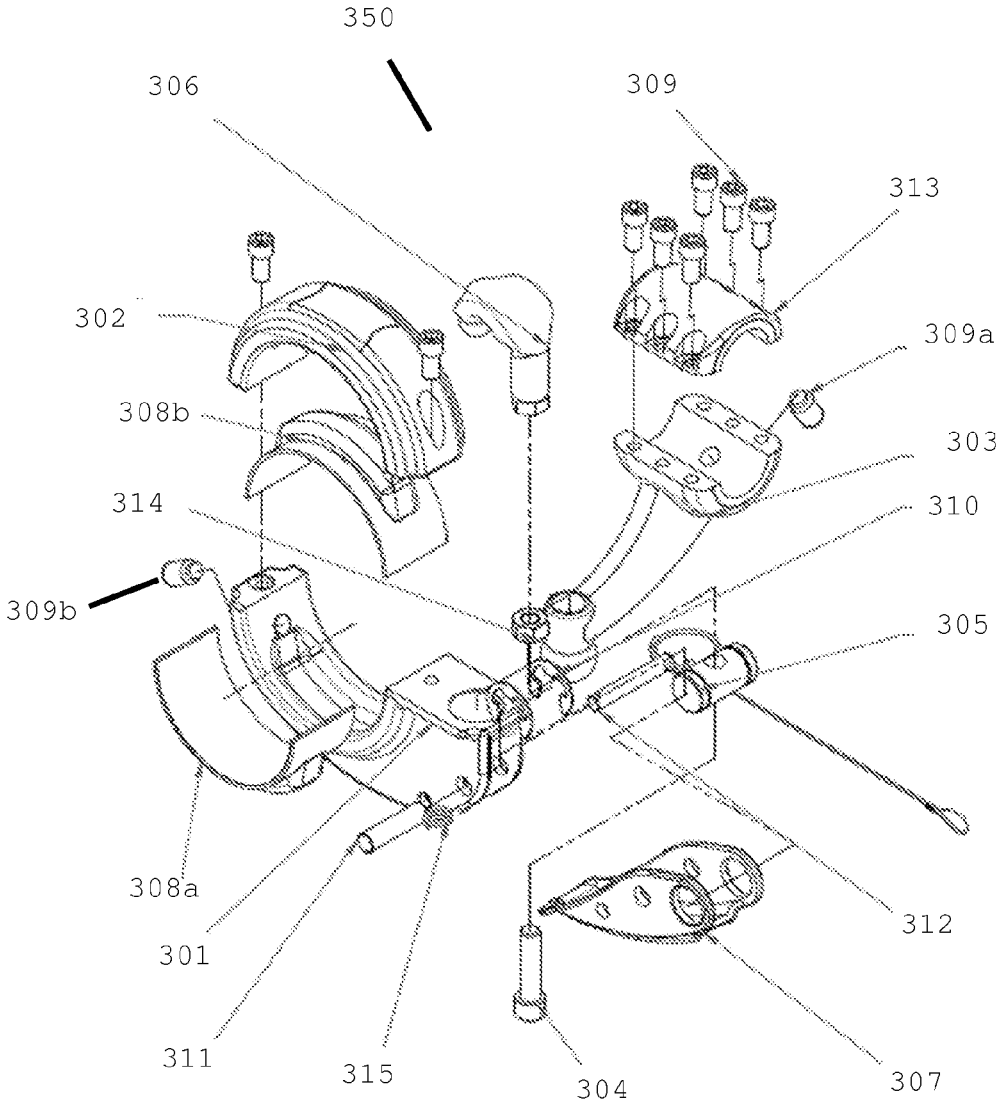
FIG. 7 shows an exploded view of a rack shackle clamp.

Each rack shackle clamp 350 also includes positioning inserts 308*a*, and 308*b*, as shown in FIG. 7. The inserts 308*a* and 308*b* are composed of rubber, plastic, or similar material and are positioned to seat respectively within the lower clamp bottom 301 and the lower clamp top 302 to inhibit rotation of the rack shackle clamp 350 about the structure to which it is attached. Further the rotation of the rack shackle clamp 350 is inhibited by clamp stops 309*a*, 309*b* which are threaded pins inserted respectively through the upper clamp bottom 303 and the lower clamp bottom 301.

It is anticipated additional positioning mechanisms may be used such as a protrusion/depression combination to inhibit rotation of the clasp member about the boat tower support 114*a*. For example, a protrusion may be provided on the clasp member which seats within a corresponding depression formed on the boat tower support 114*a*. Alternatively, a pin can be inserted through the clasp member and the corresponding portion of the boat tower support 114*a* to prevent rotation or sliding of the clasp member.

Figure 6:
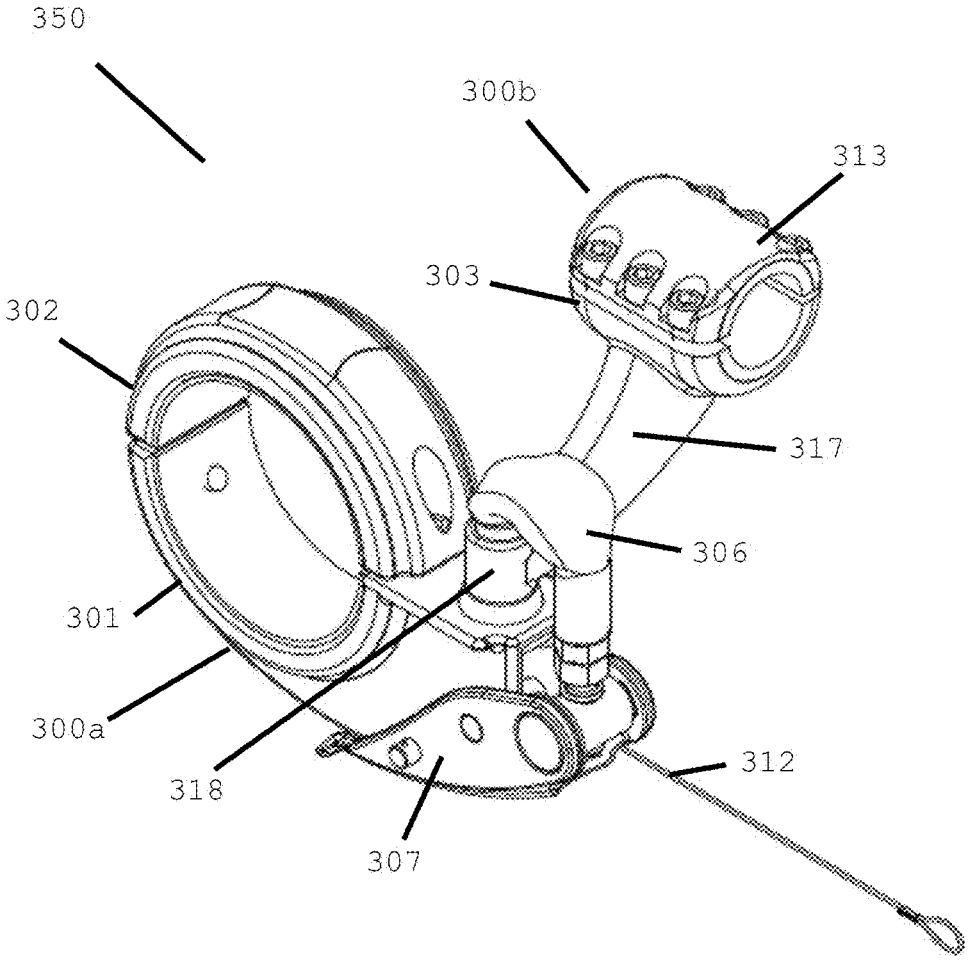
FIG. 6 shows an assembled rack shackle clamp.

The rack shackle clamp 350 is assembled as shown in FIGS. 6-7 and attaches the cargo rack apparatus 110 to the boat tower 114 by interconnecting a cargo rack peripheral rail 122 to a boat tower support 114*a*.

With the rack shackle clamp 350 interconnecting the cargo rack apparatus 110 to the boat tower 114, by simply operating the rack shackle clamp release handle the cargo rack apparatus 110 can be separated from the boat tower 114 and the cargo rack apparatus 110 can be pivoted or removed as needed.

The rack shackle clamp 350 provides structurally unique features such as variable mounting configuration where the shackle can be adjusted to clamp onto support members which are aligned parallel or askew. Further rack shackle clamp 350 provides a rigid but dampened interconnection between the cargo rack and the boat support.

Cargo Rack Mount Adapter

Figure 8A:
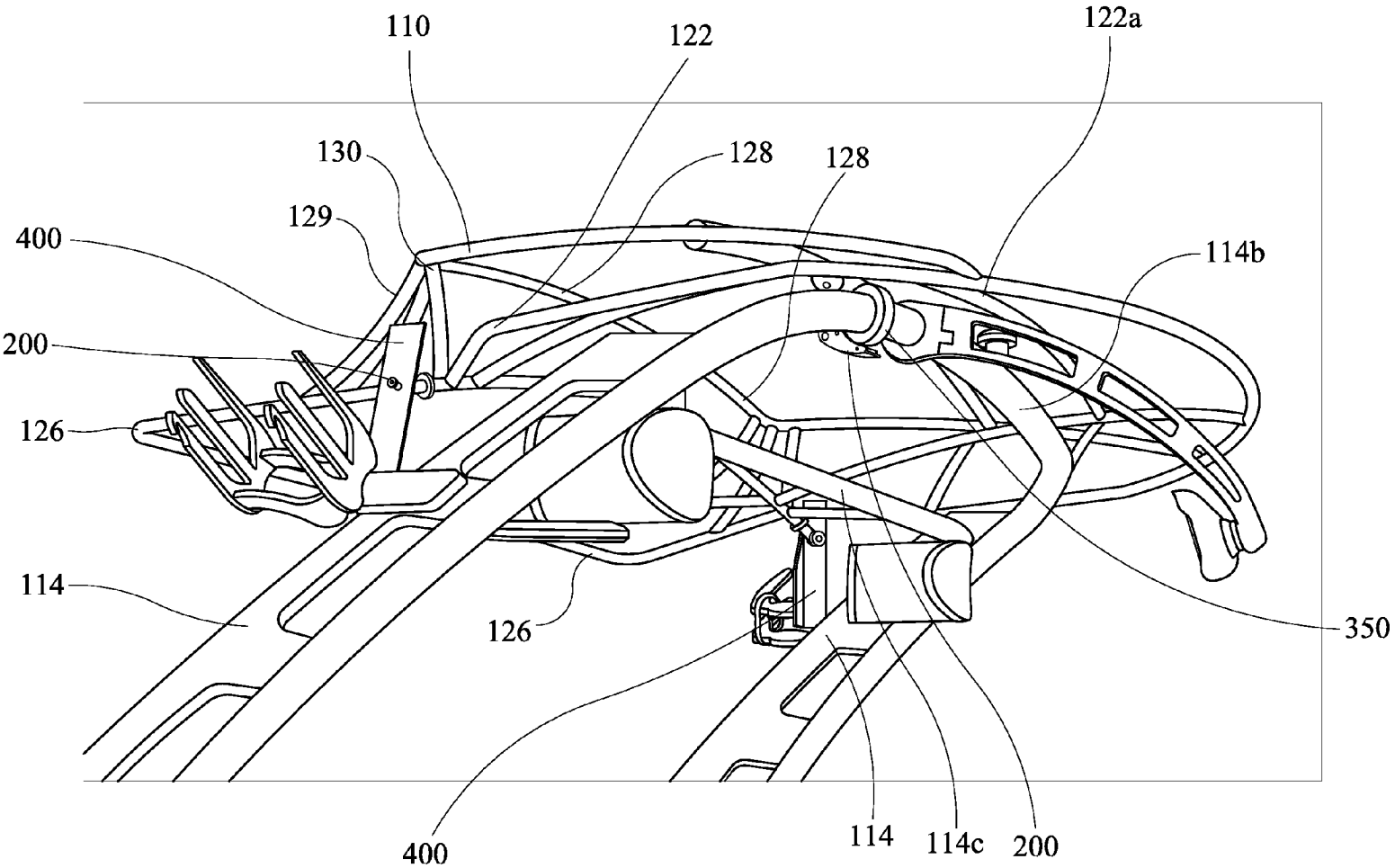
FIG. 8A shows an embodiment of the cargo rack apparatus.
Figure 8B:
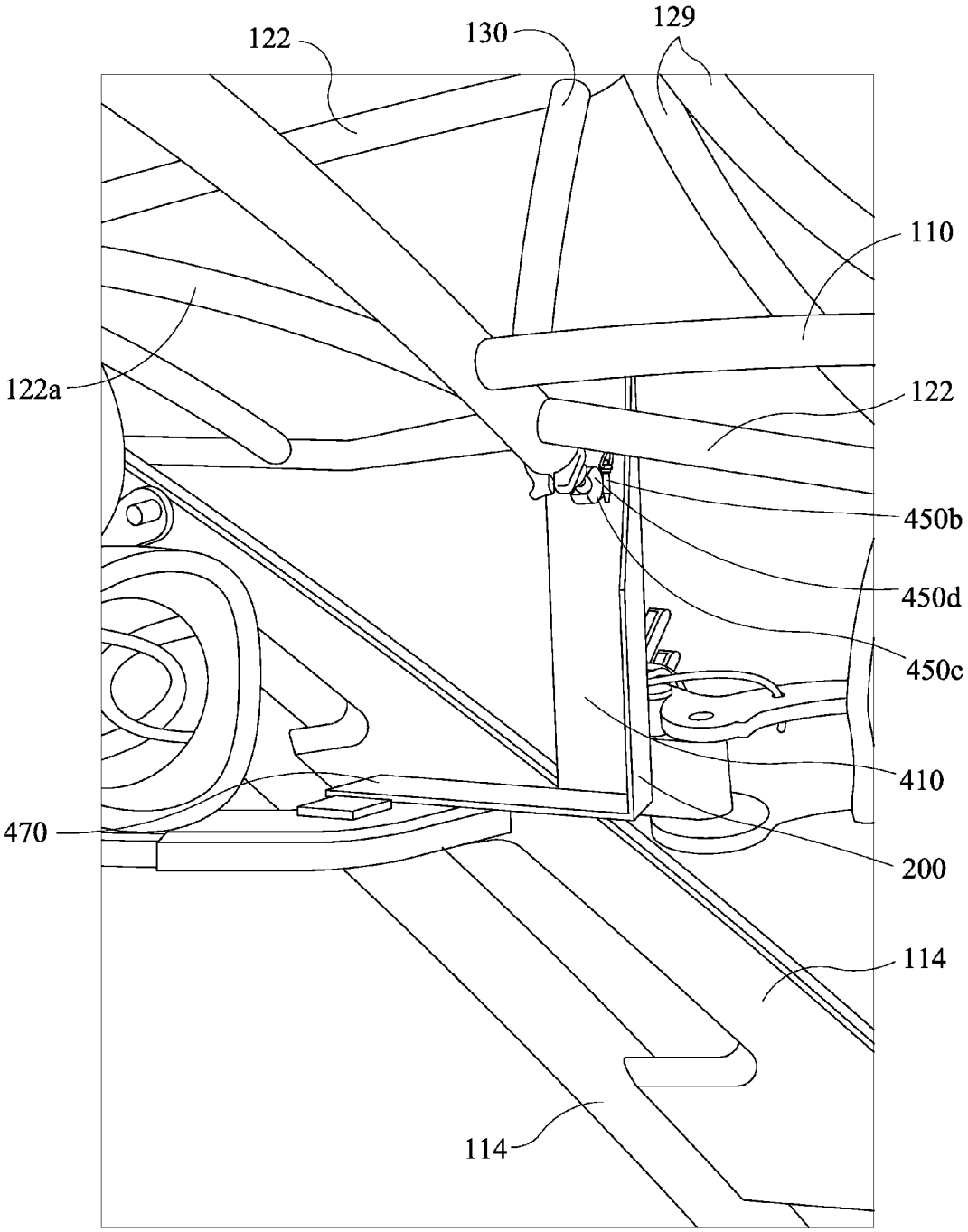
FIG. 8B shows an embodiment of the cargo rack apparatus.
Figure 8C:
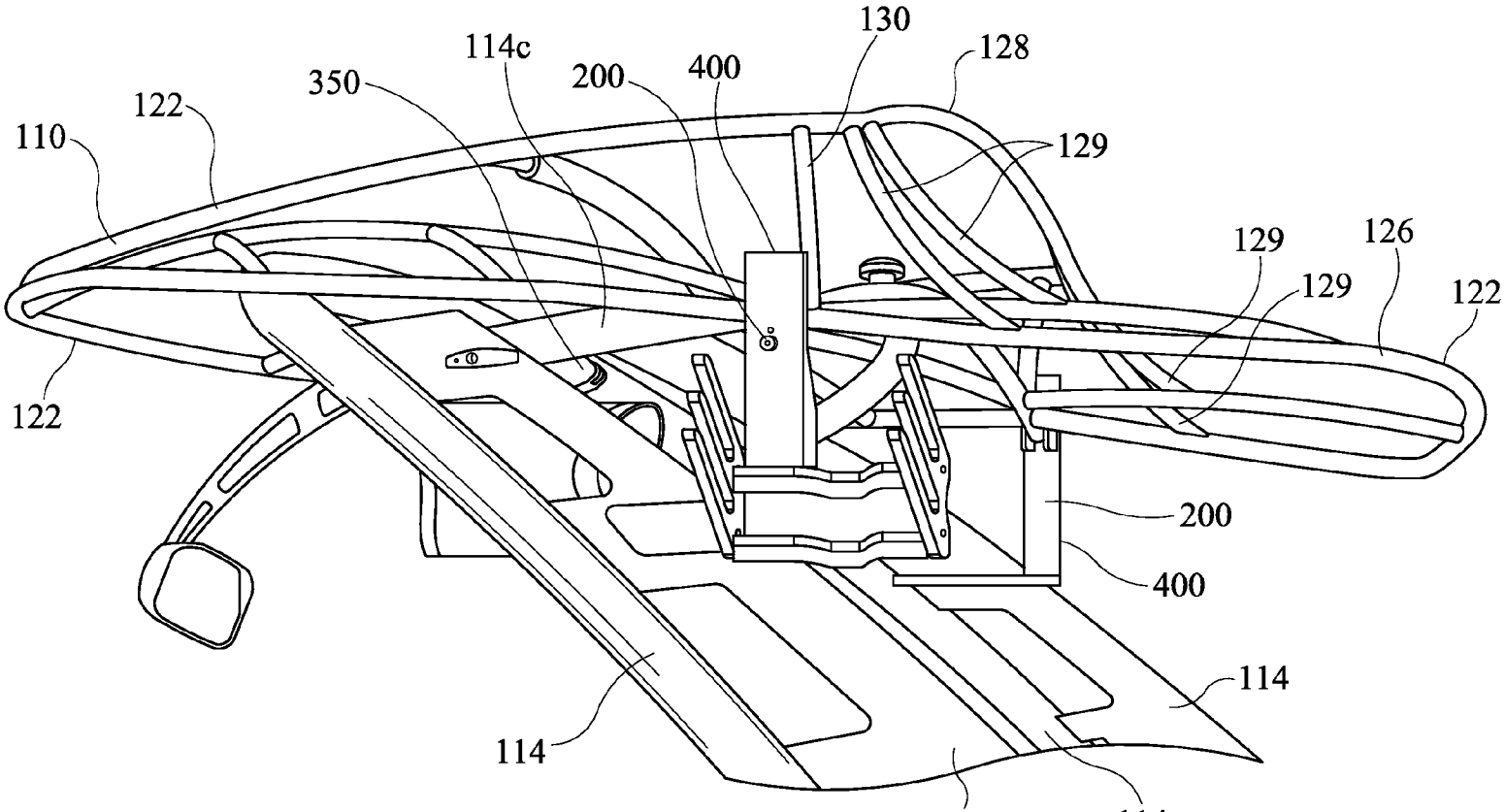
FIG. 8C shows an embodiment of the cargo rack apparatus.
Figure 8D:
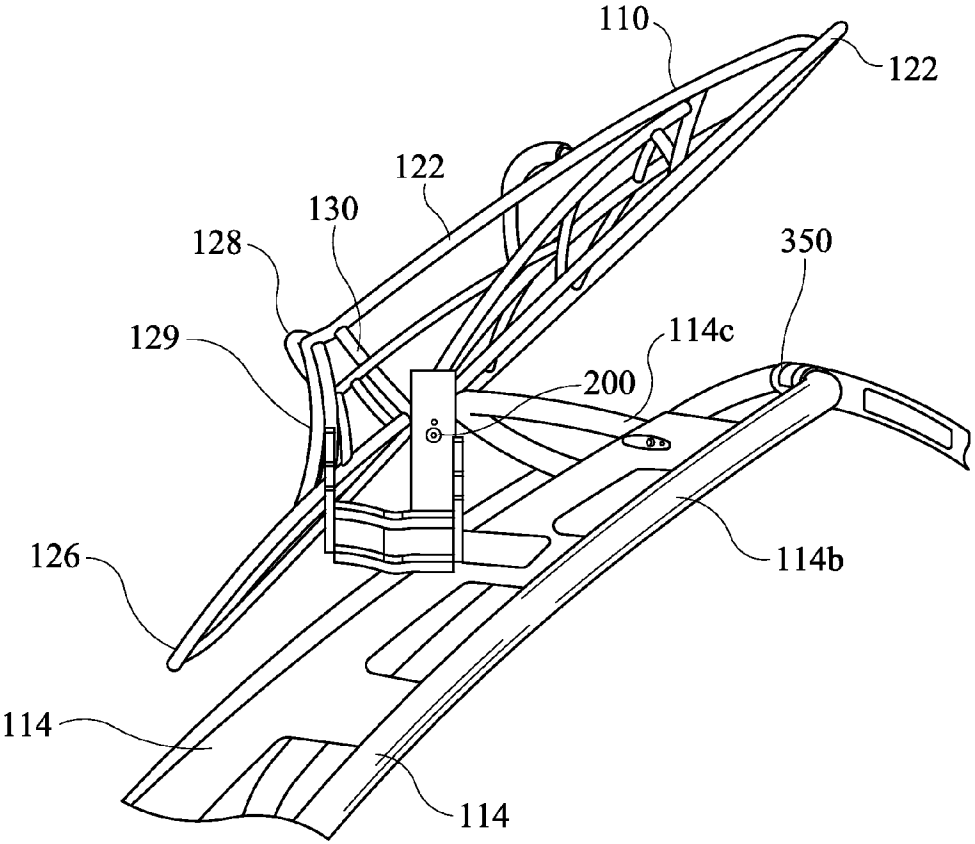
FIG. 8D shows an embodiment of the cargo rack apparatus.
Figure 8E:
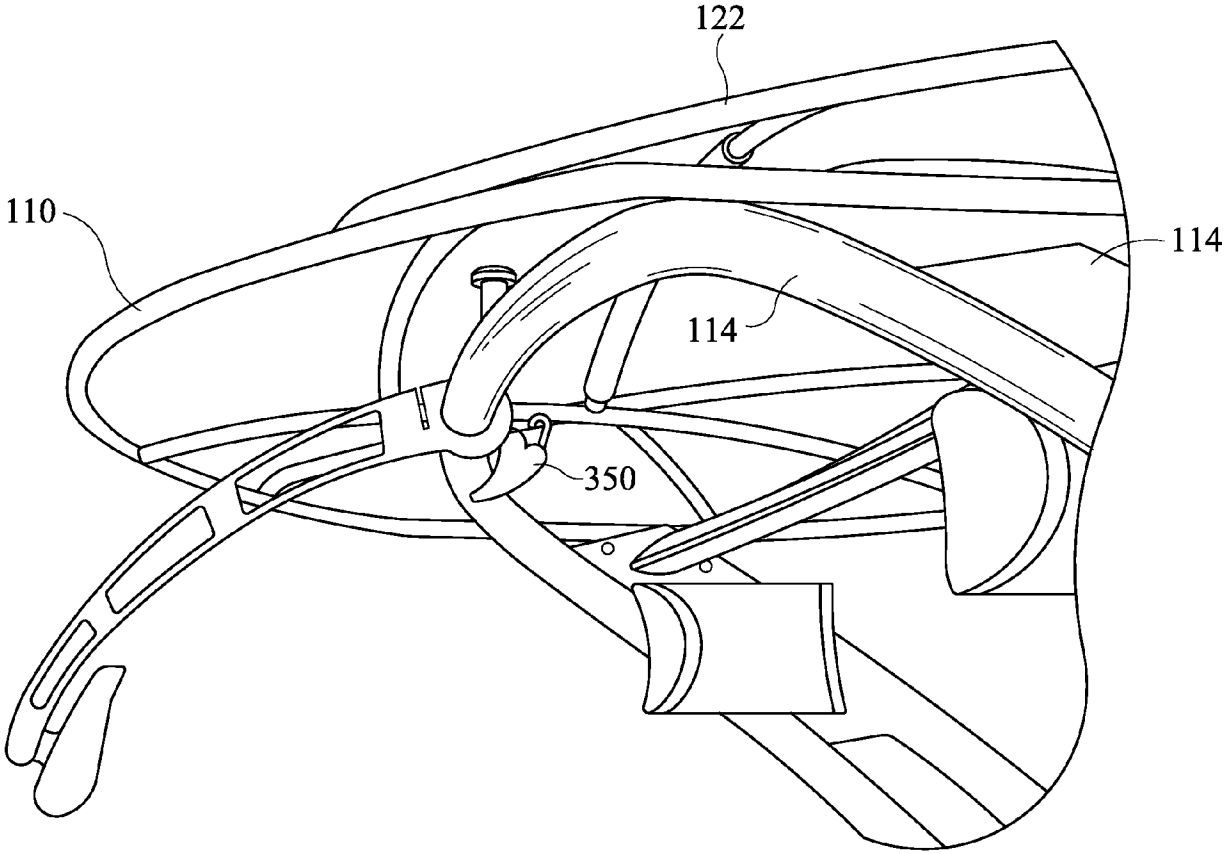
FIG. 8E shows an embodiment of the cargo rack apparatus.
Figure 8F:
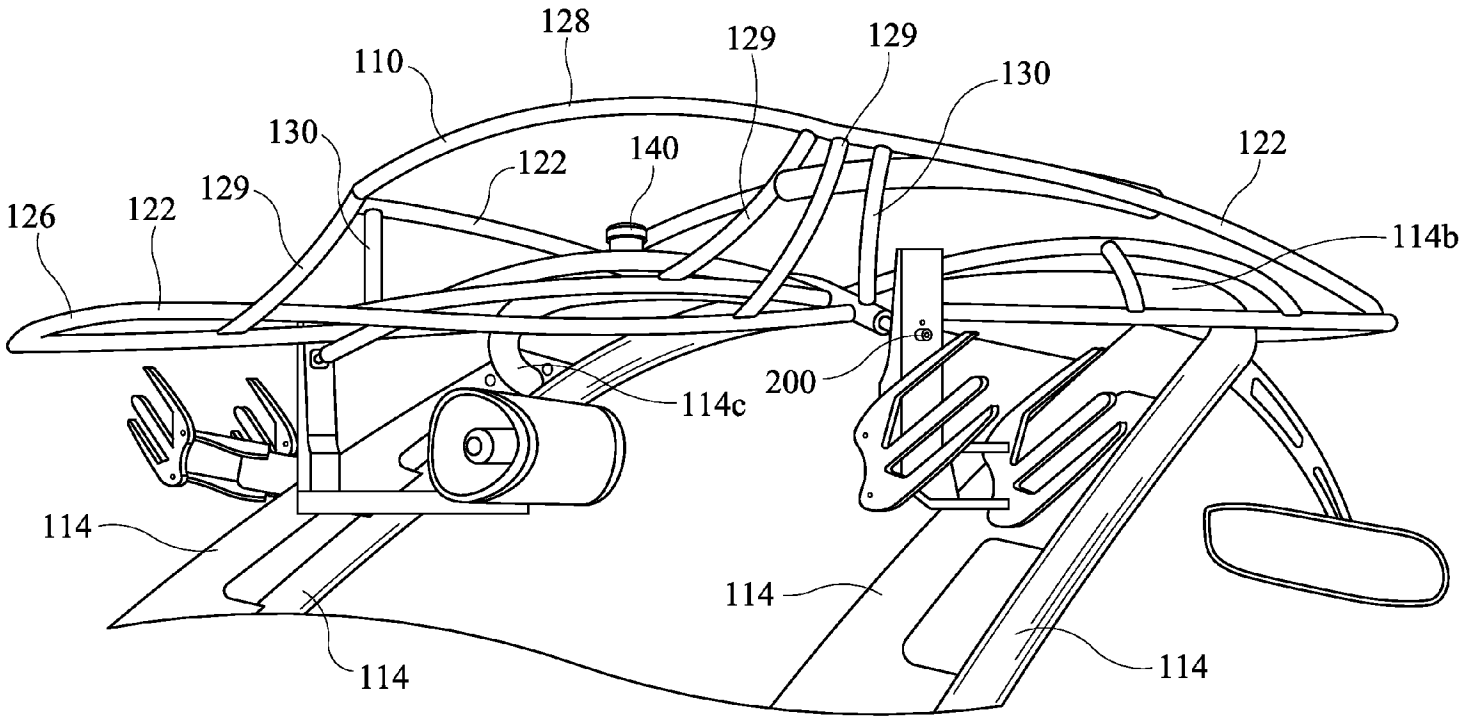
FIG. 8F shows an embodiment of the cargo rack apparatus.
Figure 8G:
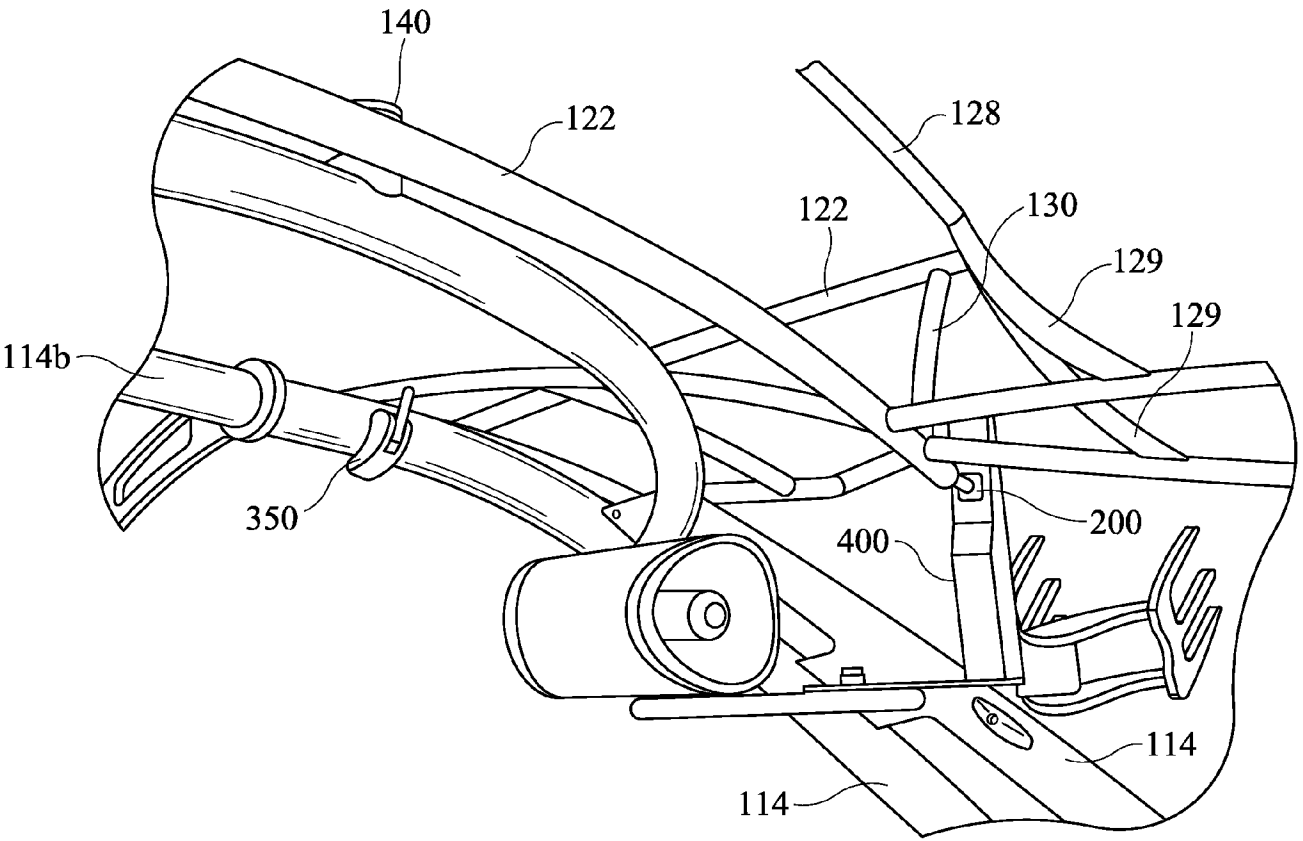
FIG. 8G shows an embodiment of the cargo rack apparatus.
Figure 9:
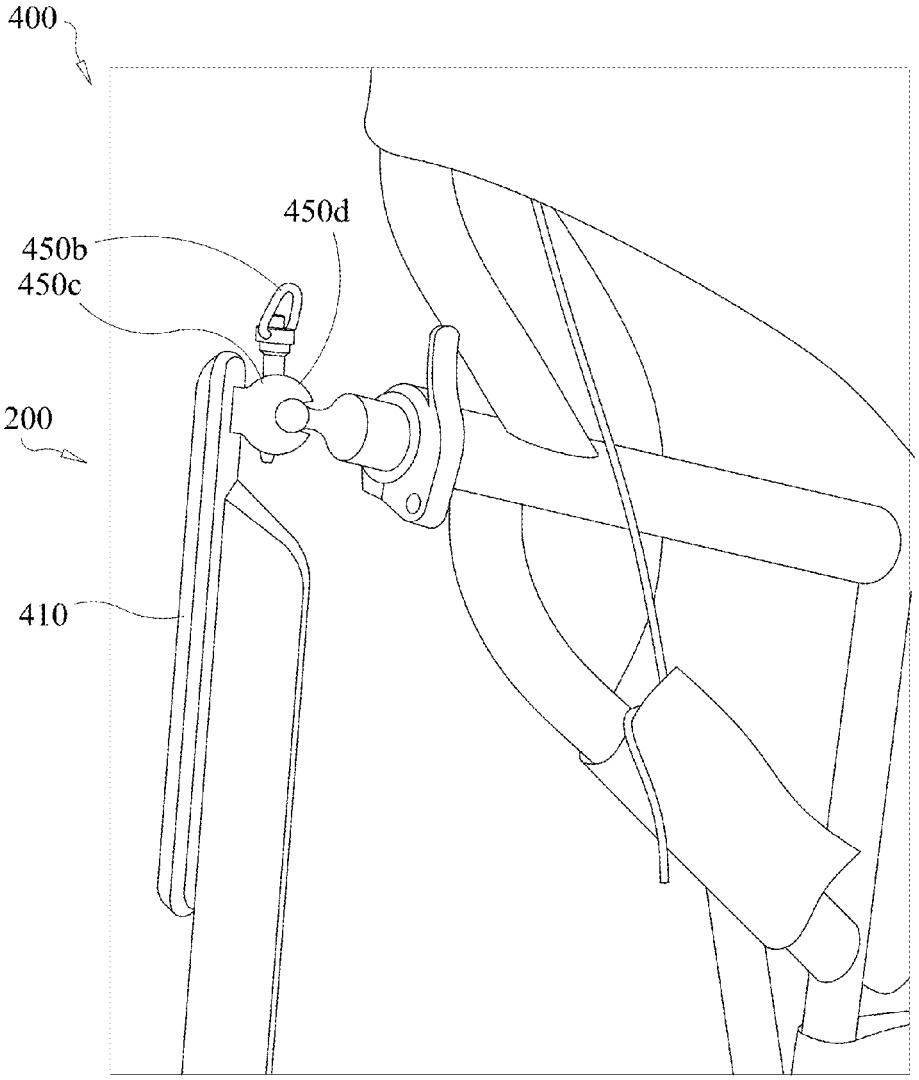
FIG. 9 shows an embodiment of the cargo rack mount adapter.

The mounting apparatus 200 of the instant invention further includes a cargo rack mounting adapter 400, as shown at least in FIG. 8A-9 for use as an intermediate interface between the cargo rack apparatus 110 and the boat tower 114.

The cargo rack mount adapter 400 includes at least a rack mount adapter removable pin 450*b*, a rack mount adapter socket 450*c*, a rack mount adapter pin hole 450*d*, a rack mount adapter support 410, and rack mount adapter connection elements 470 (such as nuts, bolts, washers, and mounting holes appropriately positioned).

The rack mount adapter removable pin 450*b*, rack mount adapter socket 450*c*, and rack mount adapter pin hole 450*d* are positioned on the rack mount adapter support 410 at a position adjacent to each pivoting rack link connector ball 150*a* (note as shown in FIGS. 8A and 8B the pivoting rack link connector ball 150*a* is extending out of a the cargo rack apparatus 110 at a position along the peripheral rails 122). Further, the rack mount adapter support 410 is fastened to the boat tower 114 at a location suitable for withstanding the weight and force load of the cargo rack apparatus 110 while also allowing for the desired range of rack movement or detachment of the cargo rack apparatus 110. The specific positioning of the rack mount adapter connection elements 470 to fasten the rack mount adapter support 410 to the boat tower 114 will depend on the structural configuration of the selected boat tower 114.

As shown in FIG. 9, the cargo rack mount adapter 400 can also be mounted on an external surface of the boat tower 114. In this configuration of the cargo rack mount adapter 400, the rack mount adapter removable pin 450*b*, rack mount adapter socket 450*c*, and rack mount adapter pin hole 450*d* are positioned on the rack mount adapter support 410 at a position forward of the releasable rack link 205*b* location.

Exemplary Cargo Rack Assembly Configurations

The cargo rack assembly 100 components of the instant invention can be configured in a variety of combinations responsive to the structure of the applicable boat tower 114.

In the preferred embodiment, as shown in FIG. 1, a set of four mounting apparatus rack links 205 connects cargo rack apparatus 110 to the boat tower 114 (note the port side rack links 205 are not shown however they are attached in the same manner and relative position as shown for the starboard side mounting apparatus rack links 205). In the preferred embodiment two pivoting rack links 205*a* and two releasable rack links 205*b* interconnect the cargo rack apparatus 110 to the boat tower 114.

In this, the preferred embodiment and best mode of the instant invention, a plurality of connectors (rack links 205) releasably suspend the cargo rack apparatus 110 within the vertical supports 114*a* of the boat tower 114, and cargo rack apparatus 110 is removably and pivotally attached to each of the port and starboard vertical supports 114*a* at a location between the upper and lower ends of the vertical supports, and the cargo rack member can tilt down within the said vertical supports of the boat tower for access to stored equipment.

Specifically as shown in FIG. 1, the selected mounting apparatus 200 includes two pivoting rack links pivotally connecting the peripheral rails 122 of the cargo rack apparatus 110 to, and within, the vertical supports 114*a* of the boat tower 114; and two releasable rack links 205*b* pivotally and releasably connecting the peripheral rails 122 of the cargo rack apparatus 110 to, and within, the vertical supports 114*a* of the boat tower 114. In this configuration the pivoting rack links 205*a* are positioned foreword of the releasable rack links 205*b* with respect to the fore and aft plane of the boat. In this configuration when the releasable rack links 205*b* are disconnected, the cargo rack apparatus 110 can be pivoted about the pivoting rack links 205*a* (such as by swinging the cargo rack apparatus back rail 126 downward towards the boat deck).

Further, as shown in FIG. 1A, the two releasable rack links 205*b* pivotally and releasably connect the peripheral rails 122 of the cargo rack apparatus 110 to, and within, the substantially horizontal portion 114*b* of the boat tower 114.

In an alternate embodiment, (not shown) the positions of the pair of pivoting rack links 205*a* and the releasable rack links 205*b* are reversed from the preferred embodiment such that the pivotal pivoting rack links 205*a* are positioned rearward (or aft) of the releasable rack links 205*b* with respect to the fore and aft plane of the boat. As in the preferred embodiment, in this alternate embodiment the cargo rack apparatus 110 is suspended within the vertical supports 114*a* of the boat tower 114. In this configuration when the releasable rack links 205*b* are disconnected, the cargo rack apparatus 110 can be pivoted about the pivoting rack links 205*a* (such as by swinging the cargo rack apparatus back rail 126 away from the boat deck).

An important distinction between the preferred embodiment and this particular alternate embodiment is that in the preferred embodiment the configuration of the mounting apparatus 200 allowed pivoting of the back rail 126 of cargo rack apparatus 110 towards the boat deck whereas in this alternate embodiment the configuration of the mounting apparatus 200 allows pivoting of the back rail 126 of cargo rack apparatus 110 away from the boat deck.

Figure 1B:
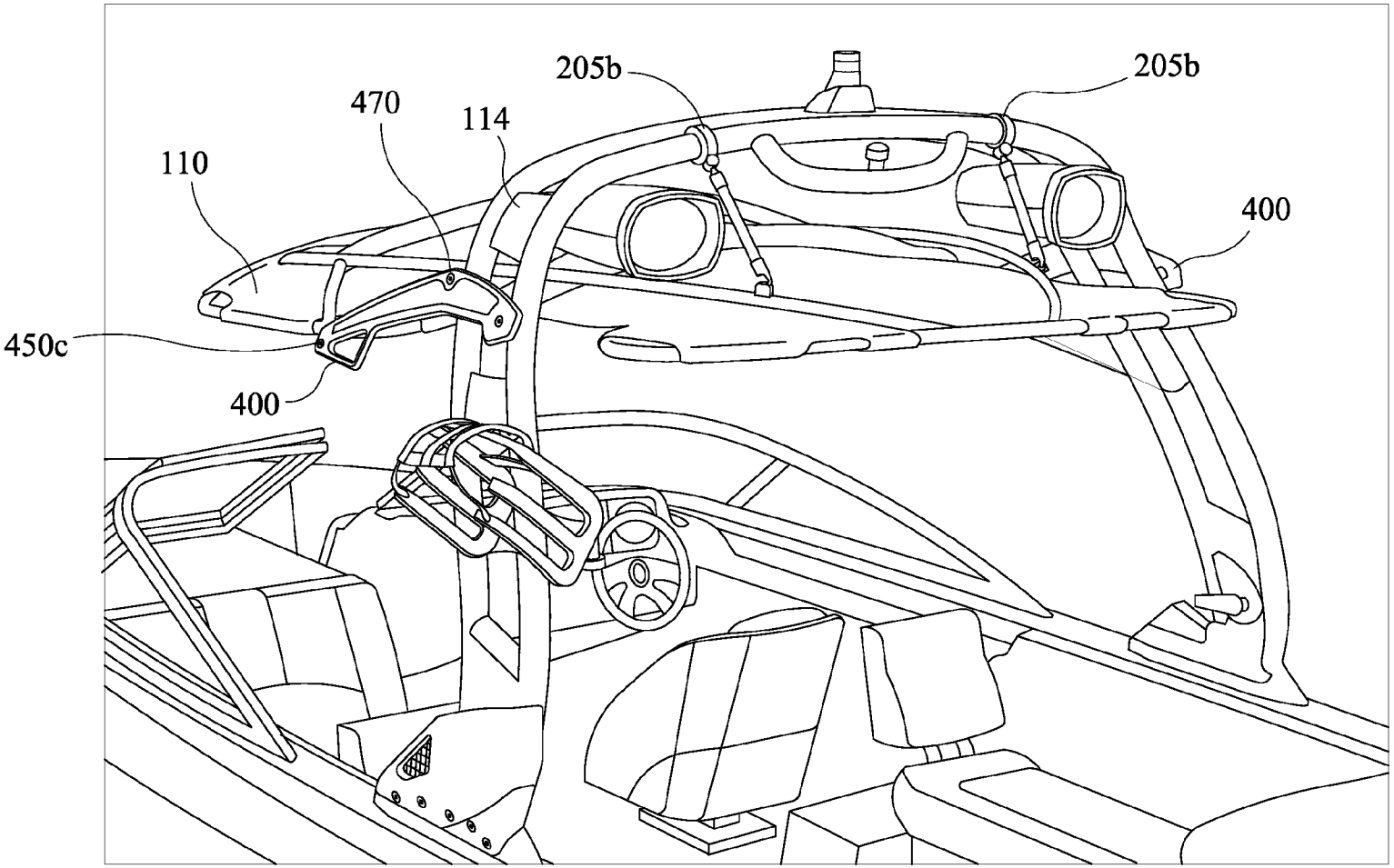
FIG. 1B presents a cargo rack assembly mounted on a boat via the rack mount adapter.

In another alternate embodiment, as shown in FIG. 1B, a pair of rack mount adapters 400 are positioned forward of releasable rack links 205*b* with respect to the fore and aft plane of the boat. In this alternate embodiment the rack mount adapter 400 interconnects the pivoting rack link connector ball 150*a* of the pivoting rack link 205*a* (which extends from cargo rack apparatus 110) to the boat tower 114 and specifically to the rack mount adapter socket 450*c* (which is positioned on the rack mount adapter support 410 and about which the cargo rack apparatus 110 rotates when the releasable rack links 205*b* are disconnected). The rack mount adapter socket 450*c* is positioned on the rack mount adapter support 410 at a distance selected as suitable for the applicable cargo rack/tower combination. Rack mount adapter 400 is rigidly connected to the boat tower 114 by the rack mount adapter connection elements 470.

In another alternate embodiment, (not shown), a pair of rack mount adapters 400 are positioned rearward of the releasable rack links 205*b* with respect to the fore and aft plane of the boat. In this alternate embodiment the rack mount adapter 400 interconnects the pivoting rack link connector ball 150*a* of the pivoting rack link 205*a* (which extends from cargo rack apparatus 110) to the boat tower 114 and specifically to the rack mount adapter socket 450*c* (which is positioned on the rack mount adapter support 410 and about which the cargo rack apparatus 110 rotates when the releasable rack links 205*b* are disconnected). The rack mount adapter socket 450*c* is positioned on the rack mount adapter support 410 at a distance selected as suitable for the applicable cargo rack/tower combination. Rack mount adapter 400 is rigidly connected to the boat tower 114 by the rack mount adapter connection elements 470.

In another alternate embodiment, (not shown), the pair of foreword mounted pivoting rack links 205*a* of the preferred embodiment are replaced by at least one rack shackle clamp 350. Further, the pair of rearward mounted releasable rack links (205*b*) of the preferred embodiment are replaced by a pair of pivoting rack links 205*a* so that the mounting apparatus 200 of this embodiment includes at least one rack shackle clamp 350 positioned forward of a pair of pivoting rack links (205*a*) with respect to the fore and aft plane of the boat.

Specifically, the rack shackle lower clamp 300*a* is attached to a forward portion of the boat tower 114 and the rack shackle upper clamp 300*b* is attached to a peripheral rail 122 of the cargo rack apparatus 110. This unique mounting apparatus combination allows for pivotally and releasably connecting the peripheral rails 122 of the cargo rack apparatus 110 to the top of the boat tower 114. In this alternate configuration when the releasable one rack shackle clamp 350 is disconnected, the cargo rack apparatus 110 can be pivoted about the pivoting rack links 205*a* (such as by swinging the cargo rack apparatus back rail 126 towards the boat deck).

In another alternate embodiment, as shown at least in FIG. 8A-8B, the pair of foreword mounted pivoting rack links 205*a* of the preferred embodiment are replaced by at least one rack shackle clamp 350. Further, the pair of releasable rack links (205*b*) are replaced by a pair of rack mount adapters 400 so that the mounting apparatus 200 of this embodiment includes at least one rack shackle clamp 350 positioned forward of a pair of rack mount adapters 400 with respect to the fore and aft plane of the boat.

In this alternate embodiment the rack mount adapter socket 450*c* of the rack mount adapter 400 interconnects the pivoting rack link connector ball 150*a* of the pivoting rack link 205*a* (which extends from cargo rack apparatus 110). The rack mount adapter socket 450*c* is positioned on the rack mount adapter support 410 at a distance selected as suitable for the applicable cargo rack/tower combination. Rack mount adapter 400 is rigidly connected to the boat tower 114 by the rack mount adapter connection elements 470.

In this alternate embodiment when the releasable one rack shackle clamp 350 is disconnected, the cargo rack apparatus 110 can be pivoted about the rack mount adapter socket 450*c* (such as by swinging the cargo rack apparatus back rail 126 towards the boat deck).

CONCLUSION

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed is:

1. A cargo rack apparatus removably and pivotally attached to vertical supports of a boat tower, said boat tower including at least one port vertical support interconnected to at least one starboard vertical support, each vertical support including an upper end and a lower end, said apparatus comprising:

a cargo rack member providing storage; and a plurality of connectors releasably suspending said cargo rack member about said vertical supports of the boat tower, wherein said cargo rack member is removably and pivotally attached to the interconnection of each said port and starboard vertical supports, and wherein said cargo rack member can tilt upward or downward about said vertical support attachments for access to stored equipment.

2. The cargo rack of claim 1 wherein said cargo rack member comprises at least one peripheral rail defining front, back, and side walls, and an interior volume; and at least one crossmember between at least some of said walls to provide a support surface for stored items.

3. The cargo rack apparatus of claim 2 wherein said sidewalls attach to the vertical supports of the boat tower by two forward pivot joints and two aft release joints, wherein release of said aft release joints from the aft vertical supports enables said cargo rack to pivot about the forward pivot joints so that said cargo rack can tilt down about the vertical supports of the boat tower for access to stored equipment.

4. The cargo rack apparatus of claim 2 wherein said side walls are suspended about the vertical supports of the boat tower by two forward pivot joints and two aft release joints, wherein release of said joints from the vertical supports enables the cargo rack to be completely removed from the vertical supports of the boat tower.

5. A cargo rack apparatus removably and pivotally attached to the vertical supports of a boat tower, said boat tower including at least one port vertical support and at least one starboard vertical support, each vertical support including an upper end and a lower end, said apparatus comprising:

a cargo rack member providing storage; and a plurality of connectors releasably suspending said cargo rack member above said vertical supports of the boat tower, wherein said cargo rack member is removably and pivotally attached to each said port and starboard vertical supports at a location at the upper end of the vertical supports, and wherein said cargo rack member can tilt down about the said vertical supports of said boat tower for access to stored equipment.

6. A cargo rack apparatus removably and pivotally attached to a boat tower, said apparatus comprising:

a cargo rack member providing storage; and a plurality of connectors releasably suspending said cargo rack member about said boat tower, wherein said cargo rack member is removably and pivotally positioned above said boat tower, and wherein said cargo rack member can tilt upward or downward about said boat tower for access to stored equipment.

7. The cargo rack apparatus of claim 6 wherein the cargo rack member is attached to at least one boat tower support.

8. The cargo rack apparatus of claim 7 wherein said at least one boat tower support is at least one substantially horizontal first portion interconnecting a port substantially vertical tower support and a starboard substantially vertical tower support.

9. The cargo rack apparatus of claim 8 wherein the boat tower further includes a substantially horizontal second portion interconnecting the port substantially vertical tower support and the starboard substantially vertical tower support.

10. The cargo rack apparatus of claim 9 wherein a ski tow is provided on the substantially horizontal second portion.

11. The cargo rack apparatus of claim 10 wherein said cargo rack member comprises rail portions including at least one peripheral rail defining front, back, and side walls, and an interior volume; and wherein said cargo rack member further comprises at least one crossmember interconnected between at least some of said cargo rack rail portions to provide a support surface for stored items.

12. The cargo rack apparatus of claim 11 wherein the cargo rack member further comprises at least one substantially vertical rail interconnecting at least some of said cargo rack rail portions and wherein the at least one substantially vertical cargo rack rail extends a vertical distance sufficient to form a vertical gap between at least some of said cargo rack rail portions.

13. The cargo rack apparatus of claim 12 wherein a portion of the substantially horizontal second portion of the boat tower is positioned approximate the vertical gap between the cargo rack rail portions and, wherein a ski tow is provided on the substantially horizontal second portion of the boat tower at a location within the vertical gap between the cargo rack rail portions.

14. The cargo rack apparatus of claim 7 wherein said at least one boat tower support is a port side substantially vertical tower support and a starboard side substantially vertical tower support, wherein said plurality of connectors releasably suspend said cargo rack member about said boat tower port side and a starboard side substantially vertical supports.

* * * * *

UNITED STATES PATENT AND TRADEMARK OFFICE

CERTIFICATE OF CORRECTION

PATENT NO. : 8,905,281 B2
APPLICATION NO. : 14/066629
DATED : December 9, 2014
INVENTOR(S) : Raymond L. Jesewitz It is certified that error appears in the above-identified patent and that said Letters Patent is hereby corrected as shown below:

In the Specification

Column 1, line 7, after "CROSS REFERENCE TO RELATED APPLICATIONS" please replace the entire paragraph with the below paragraph:

This application is a Continuation-In-Part of U.S. Patent Application Ser. No. 13/967,137, filed Aug. 14, 2013 (pending), which is a Continuation-In-Part of U.S. Patent Application Ser. No. 13/214,149, filed Aug. 19, 2011, issued as U.S. Pat. No. 8,567,651 which is a Continuation-In-Part of U.S. Patent Application Ser. No. 11/711,282, filed Feb. 27, 2007, and issued as U.S. Pat. No. 8,025,194, which is a Continuation-in-Part of International Application No. PCT/US2005/047583, filed 28 December 2005 [now withdrawn], which claims the benefit of Provisional Application No. 60/640,004, filed 28 December 2004 [now expired]. U.S. Patent Application Ser. No. 11/711,282 also claims the benefit of Provisional Application No. 60/777,060, filed 27 February 2006 [now expired].
Further this application is a Continuation-In-Part of U.S. Patent Application Ser. No. 13/214,149, which is a Continuation-In-Part of U.S. Patent Application Ser. No. 13/180,542, filed Jul. 11, 2011 and issued as U.S. Pat. No. 8,297,484. U.S. Patent Application Ser. No. 13/180,542 claims the benefit of U.S. Provisional Patent Application Ser. No. 61/363,259 filed Jul. 11, 2010, [expired]. Also, U.S. Patent Application Ser. No. 13/180,542 is a Continuation-In-Part of U.S. Patent Application Ser. No. 11/711,282.

Signed and Sealed this
Fourth Day of August, 2015

Michelle K. Lee

Michelle K. Lee
*Director of the United States Patent and Trademark Office*